US009969208B1

(12) United States Patent
Hall et al.

(10) Patent No.: US 9,969,208 B1
(45) Date of Patent: May 15, 2018

(54) MAGNETIC WHITEBOARD UTILITY HOLDER

(71) Applicants: David R. Hall, Provo, UT (US); William H. Reynolds, Orem, UT (US); Christopher Reynolds, Orem, UT (US); Joe Fox, Spanish Fork, UT (US)

(72) Inventors: David R. Hall, Provo, UT (US); William H. Reynolds, Orem, UT (US); Christopher Reynolds, Orem, UT (US); Joe Fox, Spanish Fork, UT (US)

( * ) Notice: Subject to any disclaimer, the term of this patent is extended or adjusted under 35 U.S.C. 154(b) by 0 days. days.

(21) Appl. No.: 15/638,875

(22) Filed: Jun. 30, 2017

(51) Int. Cl.
*B43M 99/00* (2010.01)
*B43L 1/00* (2006.01)
*B43L 1/04* (2006.01)

(52) U.S. Cl.
CPC ..... *B43M 99/006* (2013.01); *B43L 1/008* (2013.01); *B43L 1/04* (2013.01)

(58) Field of Classification Search
CPC .. B43L 1/008; B43L 1/045; B43L 1/04; B43L 21/00; B43L 21/04; B43L 19/0056; B43L 5/005; B43M 99/006; B43M 99/008; B43M 99/009; B43K 23/001; B43K 23/002; B43K 23/04; B43K 23/06; B43K 23/08; B43K 23/10; B43K 23/12
See application file for complete search history.

(56) References Cited

U.S. PATENT DOCUMENTS 1,727,189 A * 9/1929 Asche ..... B43K 23/001 131/256
D173,896 S * 1/1955 Crea ..... 131/256
2,957,270 A * 10/1960 Kennamer, Jr. ..... B43K 23/04 211/69.5
3,476,257 A * 11/1969 O'Connell ..... B60R 7/08 211/126.1
D217,993 S * 7/1970 Woofter ..... D19/23
D224,168 S * 7/1972 Hooker ..... D19/77
3,800,974 A * 4/1974 Mogel ..... B43K 23/002 211/69.1
4,121,719 A * 10/1978 Wilhelm ..... B43M 99/001 211/69.5
4,415,092 A * 11/1983 Boyer ..... B43K 23/001 211/59.2
4,875,591 A * 10/1989 Mikesell ..... B43K 23/002 211/69.1
5,203,451 A * 4/1993 Short, II ..... B43M 99/008 206/214
5,232,103 A * 8/1993 Koenig ..... B43K 23/002 211/60.1
5,337,906 A * 8/1994 Digiulio ..... B43M 99/006 211/69.1

(Continued)

*Primary Examiner* — Patrick D Hawn

(57) ABSTRACT

The utility holder was designed to allow stored markers an extended life of working effectiveness. The design has one or more cylindrical recesses with a tapered bottom in which a dry-erase marker cap may be held in place in order that a dry-erase marker may be placed inside the cylindrical recess upside down, snapping into the dry-erase marker cap. The upside down placement of the markers in the magnetic whiteboard utility holder allows the markers maximum life. There are one or more magnets on the back surface of the utility holder which allows for it to adhere to a magnetic whiteboard. The utility holder also has a cuboid recess, which allows for a dry-erase eraser to be stored.

19 Claims, 13 Drawing Sheets

(56) References Cited

U.S. PATENT DOCUMENTS 5,947,304 A * 9/1999 Thorp ..... B43M 99/004 211/69.5
D415,530 S * 10/1999 Ridder ..... D19/77
6,186,461 B1 * 2/2001 Pelaez ..... B43K 23/002 206/214
6,202,862 B1 * 3/2001 Acquaviva ..... B43K 21/003 211/60.1
6,203,878 B1 * 3/2001 Davis ..... A47B 97/04 224/270
6,257,539 B1 * 7/2001 Pelaez ..... B43K 23/002 206/214
6,663,305 B2 * 12/2003 Poulos ..... B43K 23/02 15/435
D487,170 S * 2/2004 Petruccelli ..... D28/73
6,702,112 B1 * 3/2004 Henderson ..... B25H 3/003 206/350
6,871,767 B2 * 3/2005 Perlman ..... B43K 23/04 206/214
7,014,158 B2 * 3/2006 Berry ..... A45C 11/26 211/70.6
7,314,142 B2 * 1/2008 Lyman, Jr. ..... B43K 23/002 206/214
7,419,320 B2 * 9/2008 LaBrasca ..... A45C 11/34 206/1.7
7,740,133 B2 * 6/2010 Lamas ..... A45C 11/36 206/214
7,938,268 B1 * 5/2011 Kuo ..... A45D 40/00 132/294
7,993,142 B2 * 8/2011 Kang ..... A63F 9/0641 434/429
8,032,966 B1 * 10/2011 Keller ..... B43K 23/001 15/104.92
8,439,585 B2 * 5/2013 Silva Rubio ..... B43K 23/002 206/214
9,409,437 B2 * 8/2016 Green ..... B43K 29/02
9,791,102 B2 * 10/2017 Moreau ..... F16M 13/04
2002/0146272 A1 * 10/2002 Conover ..... B43K 23/02 401/131
2008/0056805 A1 * 3/2008 Hawkins ..... B43K 23/001 401/131
2008/0166173 A1 * 7/2008 Gibbons ..... B43K 23/001 401/131
2008/0230407 A1 * 9/2008 Lamas ..... A45C 11/36 206/214
2009/0013566 A1 * 1/2009 Cetera ..... A45C 11/34 40/124.06
2011/0081191 A1 * 4/2011 Monzo ..... B43K 8/003 401/195
2011/0091860 A1 * 4/2011 Supera ..... B32B 37/182 434/409
2011/0240570 A1 * 10/2011 Ranby ..... A45C 11/34 211/10
2014/0154661 A1 * 6/2014 Bookbinder ..... B43L 1/002 434/408
2016/0144654 A1 * 5/2016 Green ..... B43K 29/02 15/105.51

* cited by examiner

MAGNETIC WHITEBOARD UTILITY HOLDER

BACKGROUND OF THE INVENTION

The present invention relates to a magnetic whiteboard utility holder for the use of storing markers, dry-erase erasers, and other implements related to the application of the utilities of a whiteboard and combinations of ferrous and non-ferrous materials in configurations that embody the function thereof. The function of the device has uses in instances of communication, instruction, demonstration and examination of art, cogitation and conception. This invention helps resolve complications associated with storage and immediate accessibility to function specific utilities and accessories.

Whiteboards have become increasingly more popular, essentially replacing chalkboards. However, there have been issues associated with whiteboards such as storing markers and dry-erase erasers in an accessible place in close proximity to the whiteboard. With larger whiteboards, there is often a ledge attached to the bottom of the whiteboard on which the markers and dry-erase erasers may rest until they are needed. However, these ledges may cause a safety hazard as clothing may snag on their corners. The present invention negates the need for such a ledge.

In the case of smaller whiteboards, which typically do not have a ledge attached to the bottom, the need still persists for an accessible place of storage for dry-erase markers, dry-erase erasers, and other useful implements. This invention helps fulfill that need.

When using a whiteboard, there are often problems of convenience, utility, and with the marker losing its ink largely due to improper storage. This invention aids in convenience such that the magnets allow the utility holder to be placed anywhere there is ferrous material that allows magnetic attraction. The channels and the placement of the planar, proportioned and sized magnets therein are unique to this design and the placement of which allows maximum magnetic attraction by minimizing the attraction distance between the adhering back-facing surface of the invention and the surface of the whiteboard. The structure of the container aids in the ability to use in a multi-use utility fashion. This invention also aids in the preservation of markers by allowing them a proper place of storage in a downward position. The utility holder can hold a plurality of markers, a dry-erase eraser, and implements that may be of similar size and use. The utility holder incorporates the use and functionality of additional implements for use in the spirit of the invention.

BRIEF SUMMARY OF THE INVENTION

A magnetic whiteboard utility holder comprises an open interior defined by a bottom wall joining front, rear, and side walls. The utility holder may be bottomless, in such event the side walls are self supporting. The rear wall comprises one or more magnets for mounting the utility holder onto the whiteboard's magnetic surface. The open interior comprises walls forming at least one cuboid and a plurality of cylinders each suitable for storing a single whiteboard marker, each marker comprising a removable cap. The cylinders comprise at least partially tapered walls at a distal end proximate the bottom wall, wherein when the marker is inserted cap first into the cylinder, the cap is held in place within the distal end when the marker is subsequently withdrawn by a user. The tapered cylinders may be bottomless to allow for removal of the cap by pushing the cap upwards through the mouth of the cylinder.

The cylinders may also be used for storage and containment of a plurality of implements such as pens and pencils. The single open-topped cuboid may be used for storage and containment of a dry-erase eraser, a dry-erase marker or markers, or a plurality of implements.

The utility holder may comprise four vertical cylindrical recesses of equal height and diameter, arranged in two isometric vertical pairs rotated on a vertical axis on opposite sides of the cuboid, whereby an isosceles trapezoidal profile view is created from the top and bottom of the utility holder. The utility holder may further comprise two parallel vertical channel-tracks of equal isometry and T-shaped from top and bottom views, situated on each side of the cuboid recess between the outer-most cylindrical recesses and the cuboid recess, wherein are embedded magnets mounted substantially planar to the back surface. The central cuboid may be equal in width, from front to back, of 1.5 diameters of a single cylindrical recess.

The whiteboard may comprise a glass surface with a white sheet of equal length and width placed directly behind it and a metal sheet of equal length and width placed directly behind the white sheet. This allows the utility holder to adhere to the whiteboard due to a magnetic attraction. The whiteboard may also be impregnated with a ferrous material or ferrous materials.

The cylinders may comprise a resilient metal projection that applies pressure to the dry-erase markers keeping them in place, allowing the invention to be placed in any position without the dry-erase markers falling out. The cuboid may have Velcro adhered to the bottom, allowing the invention to be placed in any position without the dry-erase eraser falling out given the dry-erase eraser comprises the corresponding Velcro piece, allowing it to adhere to the Velcro at the bottom of the cuboid. This may be especially useful when the utility holder is bottomless, or at least partially bottomless.

A buffering material may be firmly affixed on the back surface that covers the entire contact surface of the back of the container. This buffering material may be a sturdy, lightweight material that increases the surface friction between the back magnetic surface of the structure and the adhering ferrous surface. More effectively, this design modification enhances the magnetic properties with minimal interference between the adhering surfaces. The buffering material serves to protect the whiteboard surface and the back surface of the invention. The buffering material may be a rubber material. The buffering material may also be a microfiber, felt or felt-like material that may also serve as a dry-erase eraser or whiteboard cleaner. The buffering material may be placed on any part of the outer surface of the invention.

The whiteboard utility holder is designed to functionally have the lowest profile possible while maintaining maximum magnetic attraction. The design specifically allows stored markers and other items an extended life of working effectiveness. The magnets are placed in an efficient and convenient configuration that reduces weight and maximizes overall magnetic attraction due to proximity to the adhering surface. The shape and design of the invention is easily manufactured from several materials.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION OF THE INVENTION

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings.

Figure 1:
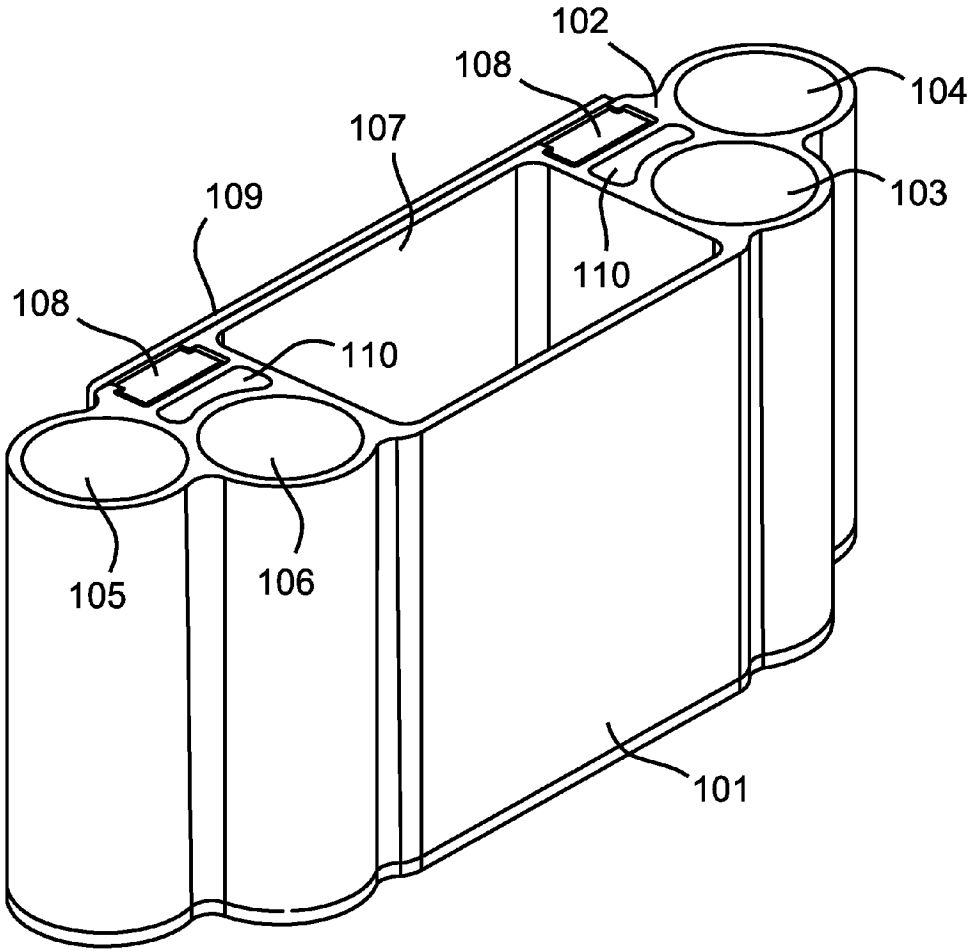
FIG. 1 is a perspective view of an embodiment of a utility holder from an upper-left viewpoint showing the front surface.

FIG. 1 shows a perspective view of an embodiment of a utility holder from an upper-left viewpoint showing a front surface 101. The utility holder comprises the front surface 101 and a top surface 102. The top surface 102 forms an isosceles trapezoidal profile view and comprises a central cuboid recess 107, two vertical bean-shaped recesses 110, and four vertical cylindrical recesses 103, 104, 105, and 106 of equal height and diameter, arranged in two isometric vertical pairs on opposite sides of the central cuboid recess 107. The cylindrical recesses 103 and 104 form one of the isometric vertical pairs and cylindrical recesses 105 and 106 form the other pair. The four vertical recesses 103, 104, 105, and 106 may hold dry-erase markers or a plurality of implements for storage and containment. The central cuboid recess 107 may hold a dry-erase eraser or one or more of dry-erase markers and a plurality of implements for storage and containment. The central cuboid recess 107 is equal in width, from front to back, of 1.5 diameters of a single cylindrical recess 103, 104, 105, or 106.

The utility holder comprises two parallel vertical channel-tracks of equal isometry and T-shaped, wherein are embedded two isometric magnets 108 of equal dimension. The T-shaped magnets 108 are mounted substantially planar to the top surface 102 and substantially planar to a back surface covered by a buffering material 109. The T-shaped magnets 108 are situated in the utility holder on each side of the central cuboid recess 107 between the outer-most cylindrical recesses 104 and 105 and the central cuboid recess 107. The T-shaped magnets 108 allow the utility holder to adhere to any ferrous surface such as a whiteboard designed with a ferrous surface.

The two bean-shaped recesses 110 serve to make the magnetic whiteboard utility holder lighter in weight. They are situated on each side of the central cuboid recess 107 from front to back between the cylindrical recesses 103 and 106 and the T-shaped magnets 108, and from side to side between the central cuboid recess 107 and the outer-most cylindrical recesses 104 and 105.

The buffering material 109 may be made of a rubber material. The buffering material 109 may also be made of a felt or felt-like material such as a microfiber material, in which the buffering material 109 may act as a dry-erase eraser. The buffering material 109 is designed to protect the back surface of the utility holder from damage due to contact with the intended adhering surface. The buffering material 109 is also designed to increase surface friction between the utility holder and the intended adhering surface.

Figure 2:
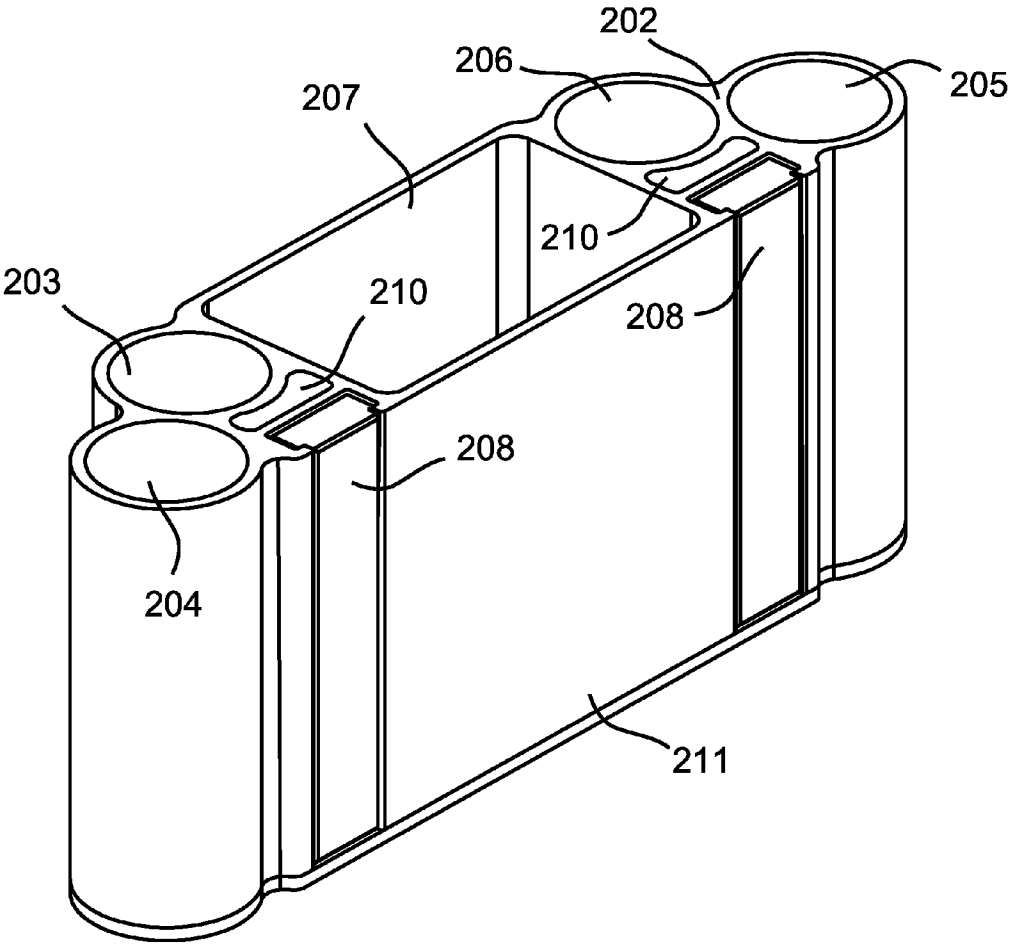
FIG. 2 is a perspective view of an embodiment of a utility holder from an upper-left viewpoint showing the back surface.

FIG. 2 shows a perspective view of an embodiment of a utility holder from an upper-left viewpoint showing a back surface 211. In this embodiment, the back surface 211 is not covered by a buffering material such as in FIG. 1. The magnetic whiteboard utility holder comprises the back surface 211 and a top surface 202. The top surface 202 comprises a central cuboid recess 207, two vertical bean-shaped recesses 210, and four vertical cylindrical recesses 203, 204, 205, and 206.

The magnetic whiteboard utility holder comprises two parallel vertical channel-tracks of equal isometry and T-shaped, wherein are embedded two isometric magnets 208 of equal dimension. The T-shaped magnets 208 are mounted substantially planar to the top surface 202 and substantially planar to the back surface 211. The T-shaped magnets 208 allow the utility holder to adhere to any ferrous surfaces such as a whiteboard designed with a ferrous surface.

Figure 3:
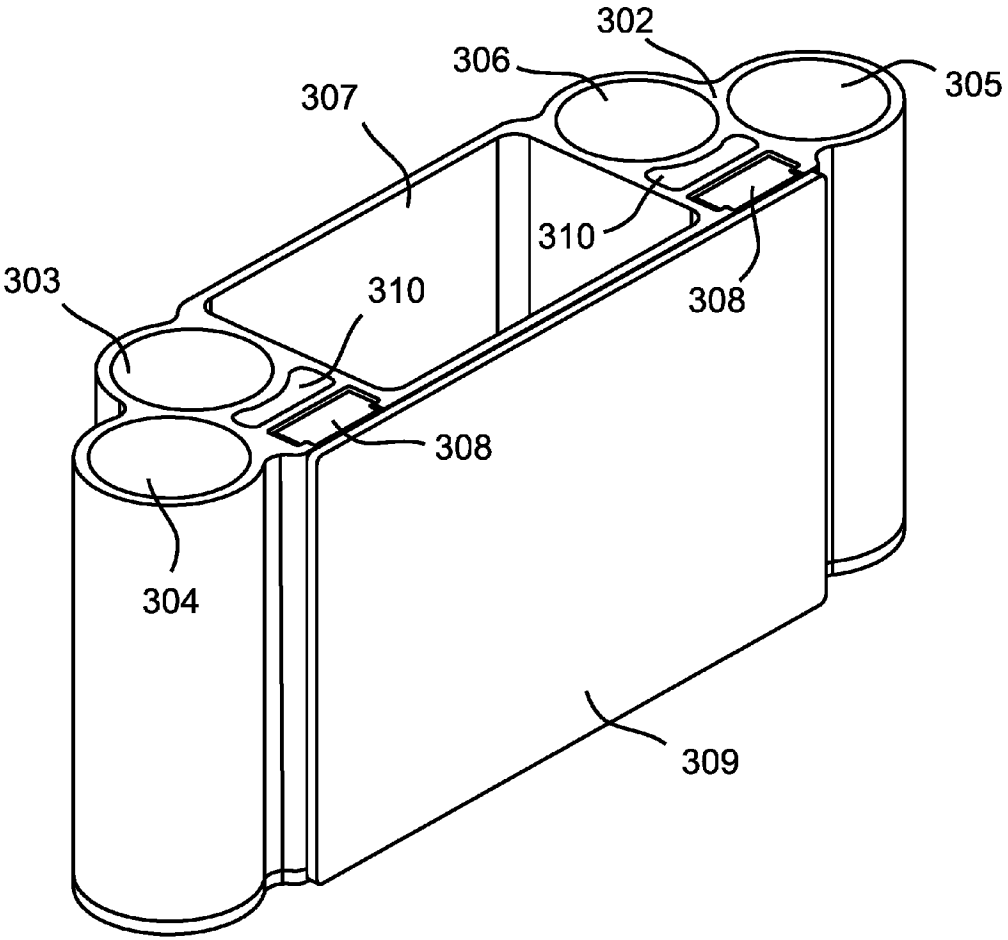
FIG. 3 is a perspective view of an embodiment of a utility holder from an upper-left viewpoint showing the back surface with a buffering material covering the back surface.

FIG. 3 shows a perspective view of an embodiment of a utility holder from an upper-left viewpoint showing a back surface covered by a buffering material 309. The utility holder comprises the back surface covered by the buffering material 309 and a top surface 302. The top surface 302 comprises a central cuboid recess 307, two vertical bean-shaped recesses 310, and four vertical cylindrical recesses 303, 304, 305, and 306.

The utility holder comprises two parallel vertical channel-tracks of equal isometry and T-shaped, wherein are embedded two isometric magnets 308 of equal dimension. The T-shaped magnets 308 are mounted substantially planar to the top surface 302 and substantially planar to the back surface. The T-shaped magnets 308 allow the utility holder to adhere to any ferrous surface such as a whiteboard designed with a ferrous surface. The buffering material 309 is thin enough to allow the T-shaped magnets 308 to adhere to a ferrous surface. The buffering material 309 protects the surface of the invention and the intended adhering surface.

Figure 4:
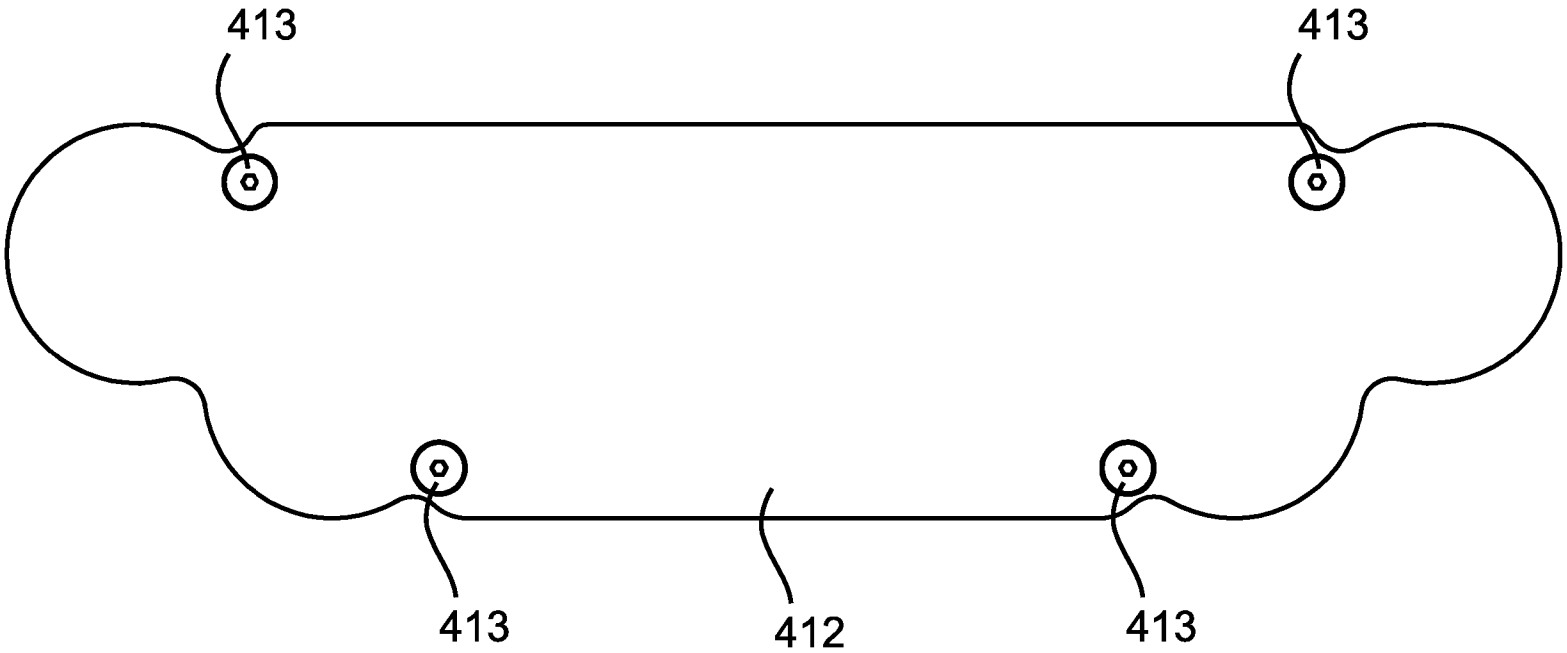
FIG. 4 is a bottom view of an embodiment of a utility holder.

FIG. 4 shows a bottom surface 412 of an embodiment of a utility holder. There are four screws 413 holding the bottom surface 412 to the utility holder. The bottom surface 412 forms an isosceles trapezoidal profile view. Alternatively, the utility holder may be bottomless, or at least partially bottomless.

Figure 5:
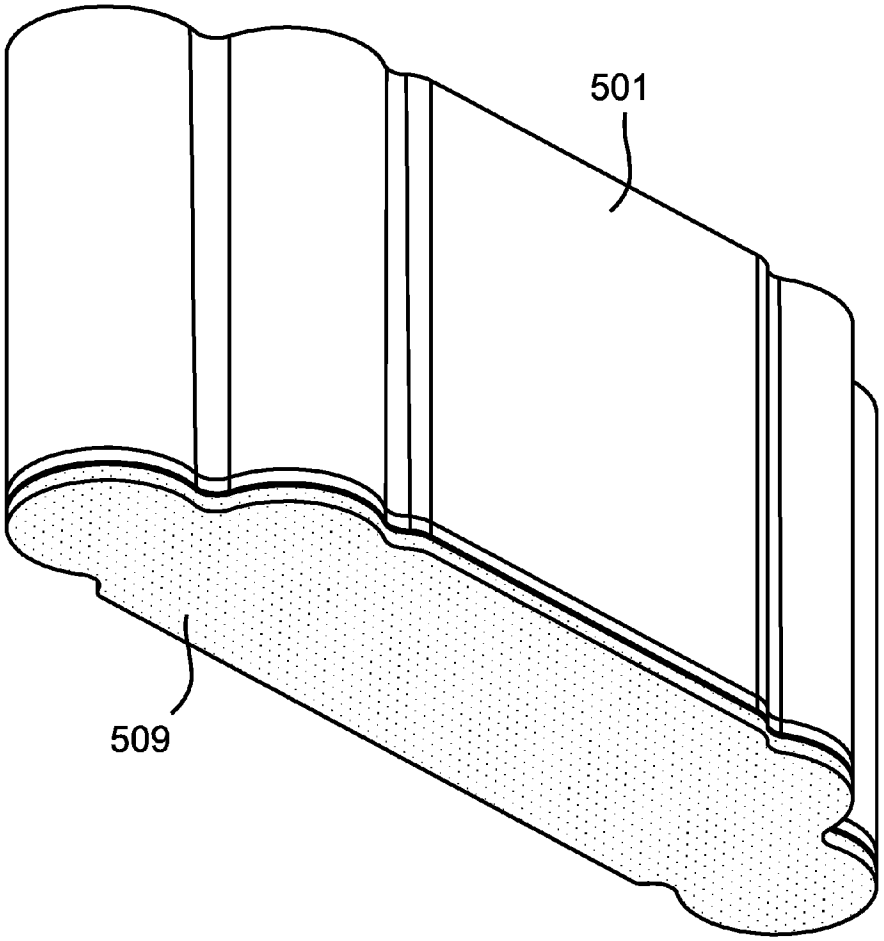
FIG. 5 is a perspective view of an embodiment of a utility holder from a lower-left viewpoint showing the front surface.

FIG. 5 shows a perspective view of an embodiment of a utility holder from a lower-left viewpoint showing a front surface 501. The utility holder comprises the front surface 501 and a bottom surface covered by a buffering material 509. The buffering material 509 is made of felt or a felt-like material such as a microfiber material. The buffering material 509 may be used as a dry-erase eraser.

Figure 6:
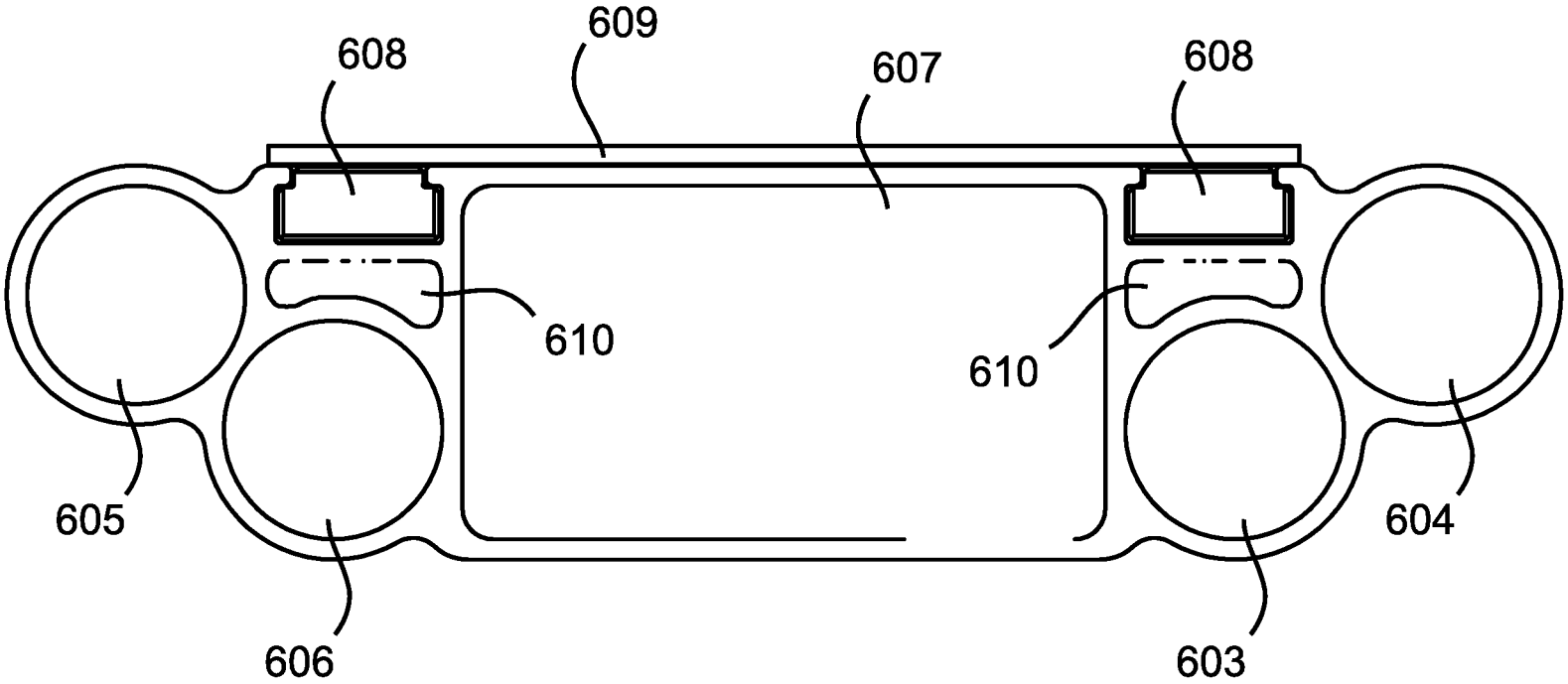
FIG. 6 is a top view of an embodiment of a utility holder.

FIG. 6 shows a top view of an embodiment of a utility holder. The utility holder comprises a top surface 602. The top surface 602 forms an isosceles trapezoidal profile view and comprises a central cuboid recess 607, two vertical bean-shaped recesses 610, and four vertical cylindrical recesses 603, 604, 605, and 606 of equal height and diameter, arranged in two isometric vertical pairs on opposite sides of the central cuboid recess 607. The cylindrical recesses 603 and 604 form one of the isometric vertical pairs and cylindrical recesses 605 and 606 form the other pair. The central cuboid recess 607 is equal in width, from front to back, of 1.5 diameters of a single cylindrical recess 603, 604, 605, or 606.

The utility holder comprises two parallel vertical channel-tracks of equal isometry and T-shaped, wherein are embedded two isometric magnets 608 of equal dimension. The T-shaped magnets 608 are mounted substantially planar to the top surface 602 and substantially planar to a back surface covered by a buffering material 609. The T-shaped magnets 608 are situated in the utility holder on each side of the central cuboid recess 607 between the outer-most cylindrical recesses 604 and 605 and the central cuboid recess 607. The T-shaped magnets 608 allow the utility holder to adhere to any ferrous surface such as a whiteboard designed with a ferrous surface.

Figure 7:
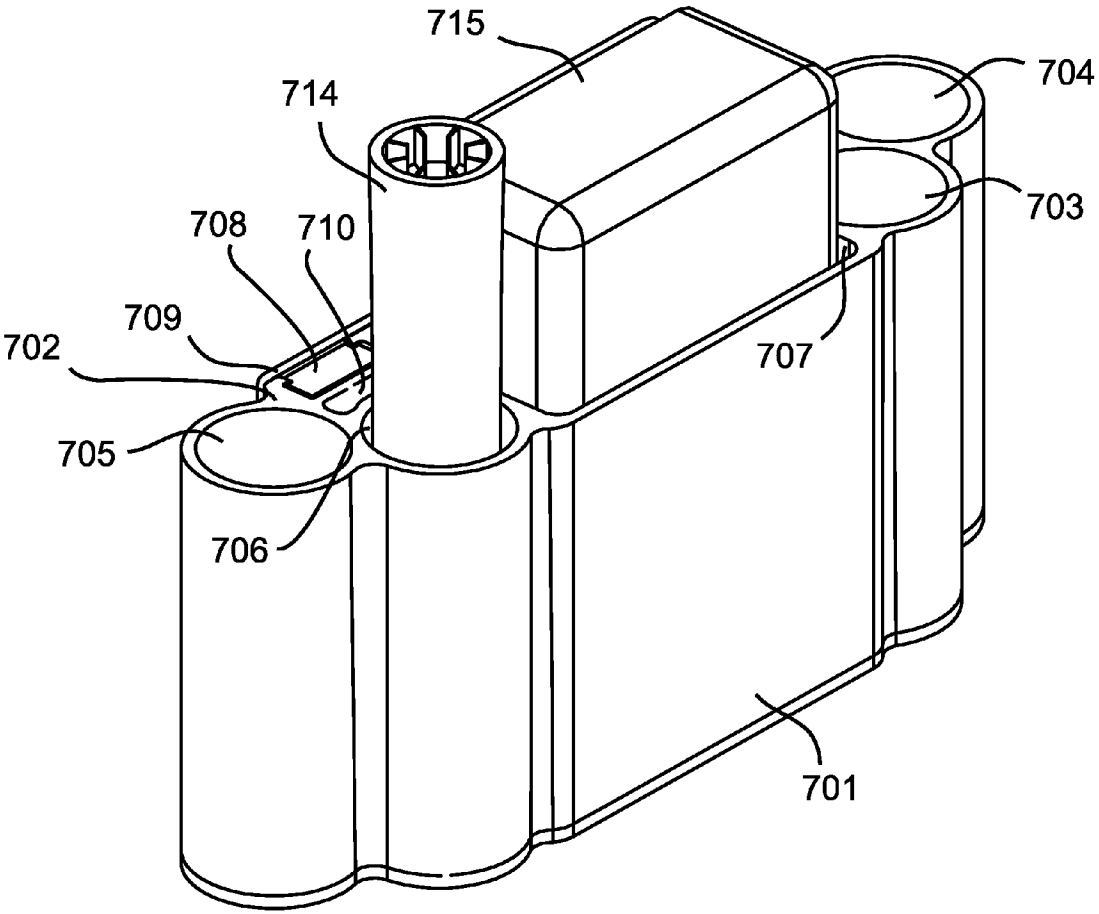
FIG. 7 is a perspective view of an embodiment of a utility holder from an upper-left viewpoint showing the front surface. There is a dry-erase marker in one of the cylinders and a dry-erase eraser in the cuboid.

FIG. 7 shows a perspective view of an embodiment of a utility holder from an upper-left viewpoint showing a front surface 701. FIG. 7 is the same as FIG. 1 except for there is a dry-erase marker 714 in a cylindrical recess 706 and a dry-erase eraser 715 in a central cuboid recess 707. The dry-erase marker 714 is placed in the utility holder upside down.

Figure 8:
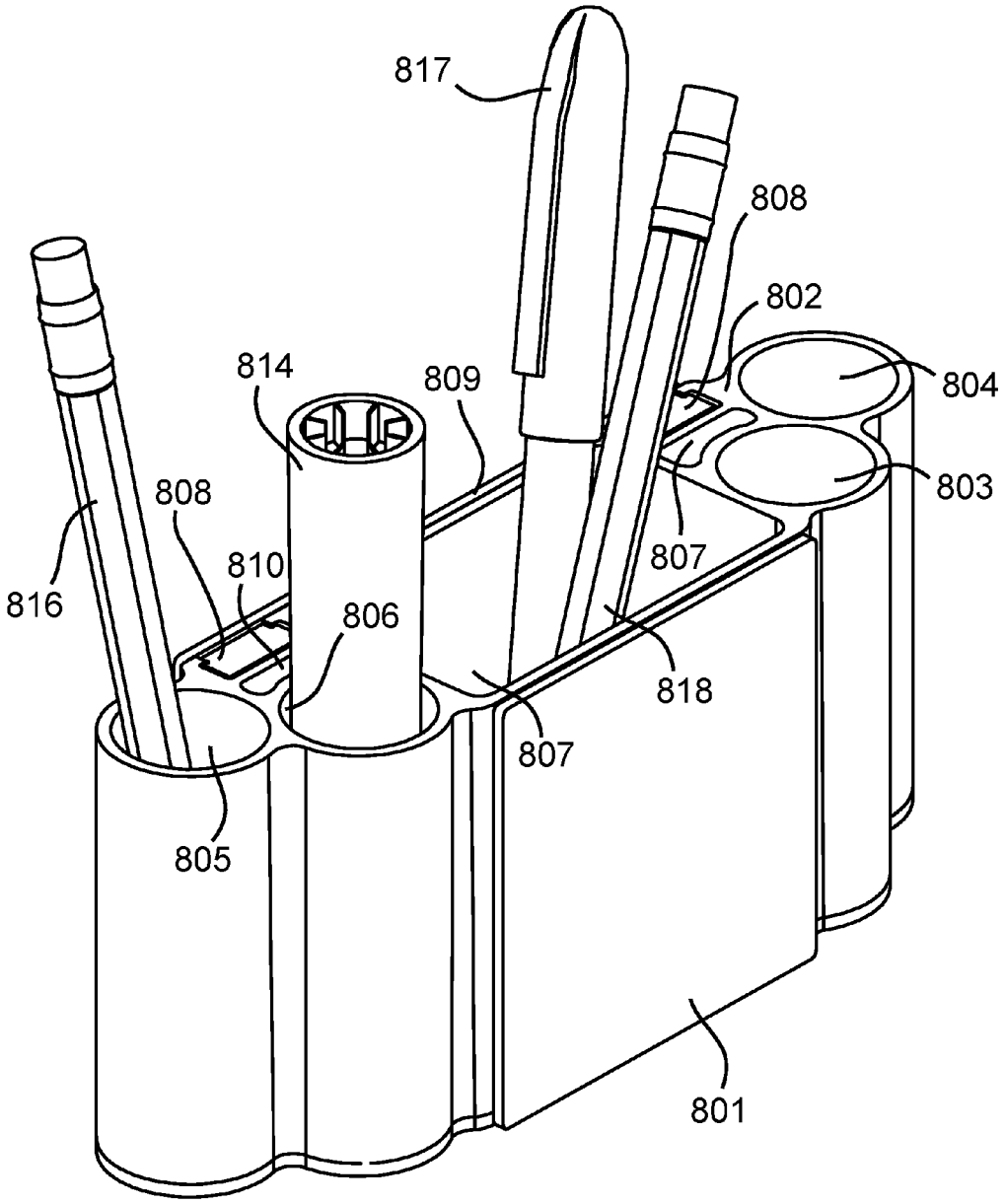
FIG. 8 is a perspective view of an embodiment of a utility holder from an upper-left viewpoint showing the front surface. There is a dry-erase marker in one of the cylinders, a pencil in another one of the cylinders, and a dry-erase marker and pencil in the cuboid.

FIG. 8 is a perspective view of an embodiment of a utility holder from an upper-left viewpoint showing a front surface 801. FIG. 8 is the same as FIG. 1 except for there is a pencil 816 in a cylindrical recess 805, a dry-erase marker 814 in a cylindrical recess 806, and a marker 817 and a pencil 818 in a central cuboid recess 807. The utility holder comprises four vertical cylindrical recesses 803, 804, 805, and 806. FIG. 8 is meant to show that any implements may be stored and contained in one or more of the cylindrical recesses 803, 804, 805, and 806. FIG. 8 is also meant to show that one or more of dry-erase markers or a plurality of implements may be stored in the central cuboid recess 807.

Figure 9:
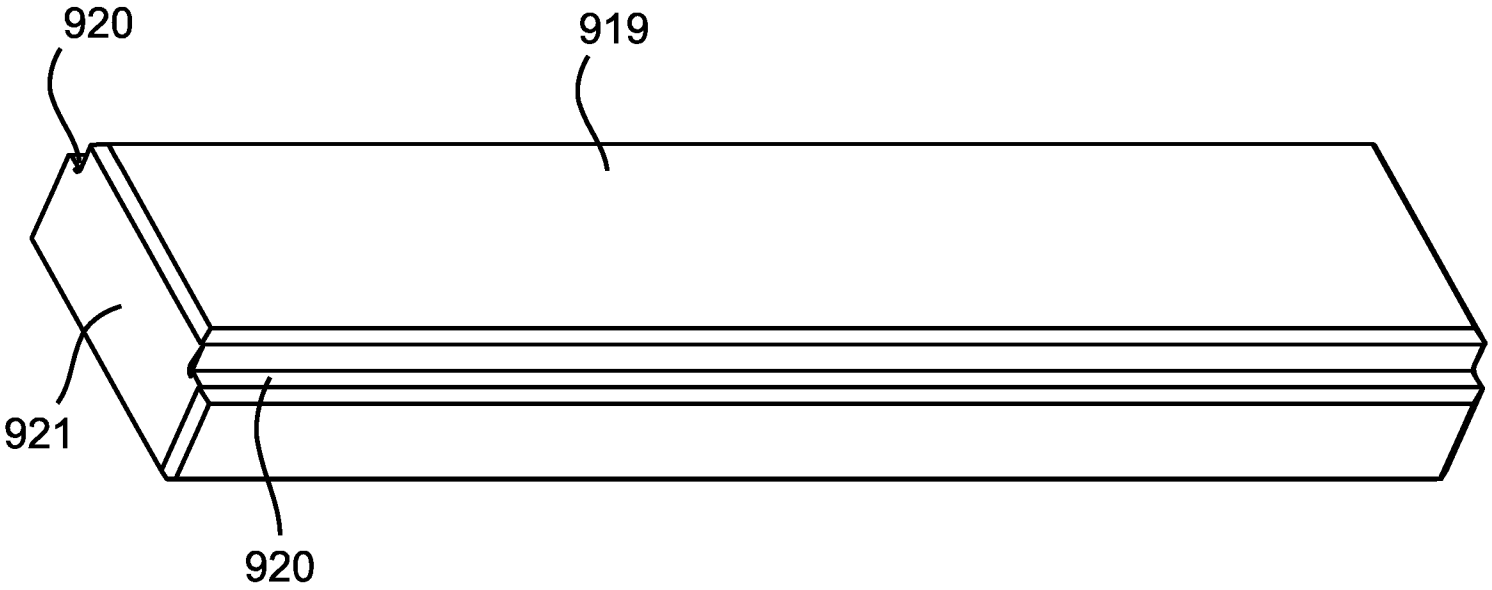
FIG. 9 is a perspective view of a T-shaped magnet.

FIG. 9 shows an embodiment of a T-shaped magnet. The T-shaped magnet comprises a T-shaped top surface 921, two ledges 920, and a back surface 919. The top surface 921 is substantially planar with a top surface of the invention. The two ledges 920 hold the magnet in place inside a T-shaped channel-track of the invention. The back surface 919 is substantially planar to a back surface of the invention.

Figure 10:
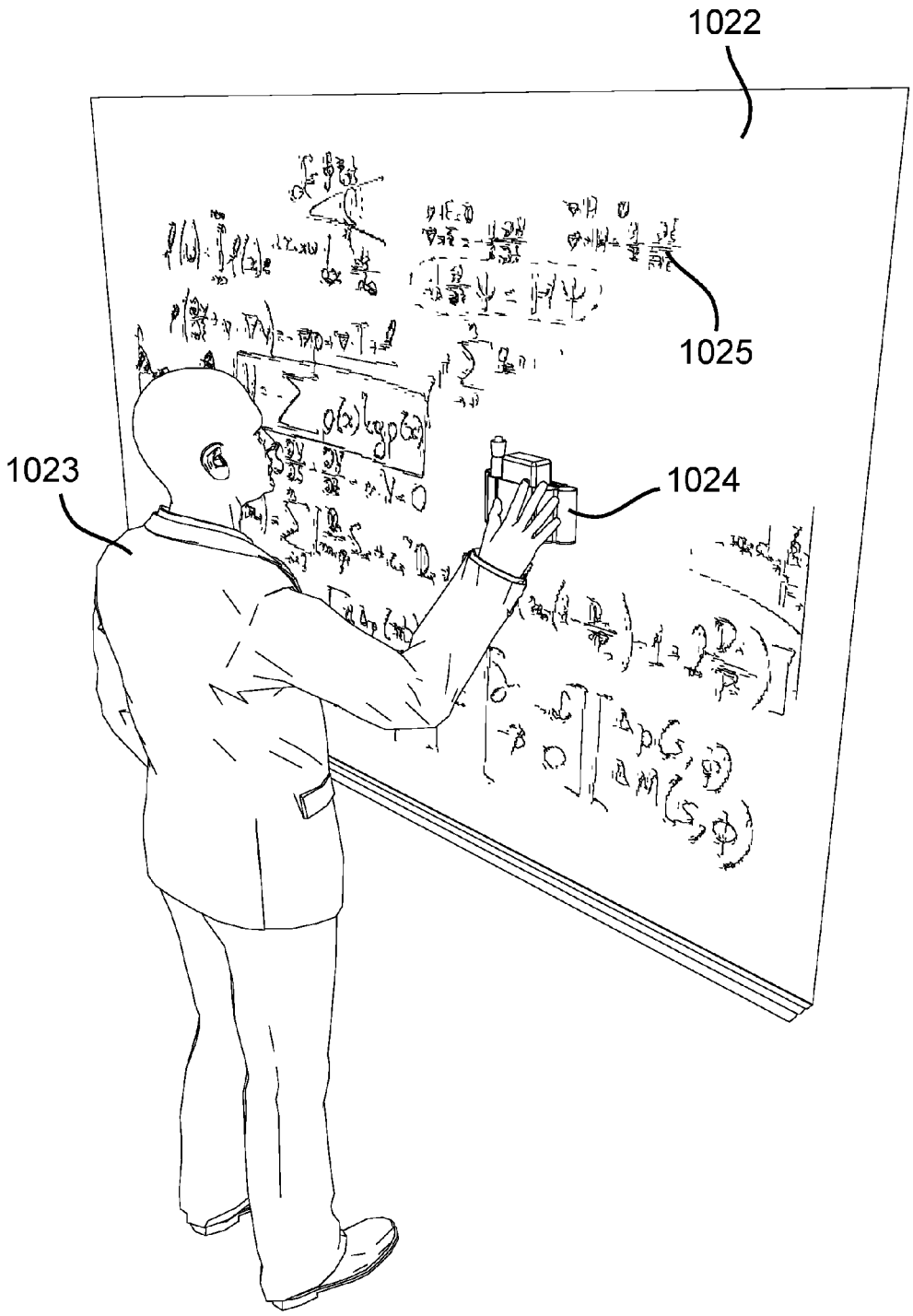
FIG. 10 shows a person holding an embodiment of a utility holder erasing markings on a whiteboard.

FIG. 10 shows a person 1023 holding an embodiment of a utility holder 1024. The person 1022 is erasing markings 1025 on a whiteboard 1022 with the utility holder 1024. The utility holder 1024 may act as a dry-erase eraser due to a buffering material covering a back surface of the utility holder 1024.

Figure 11:
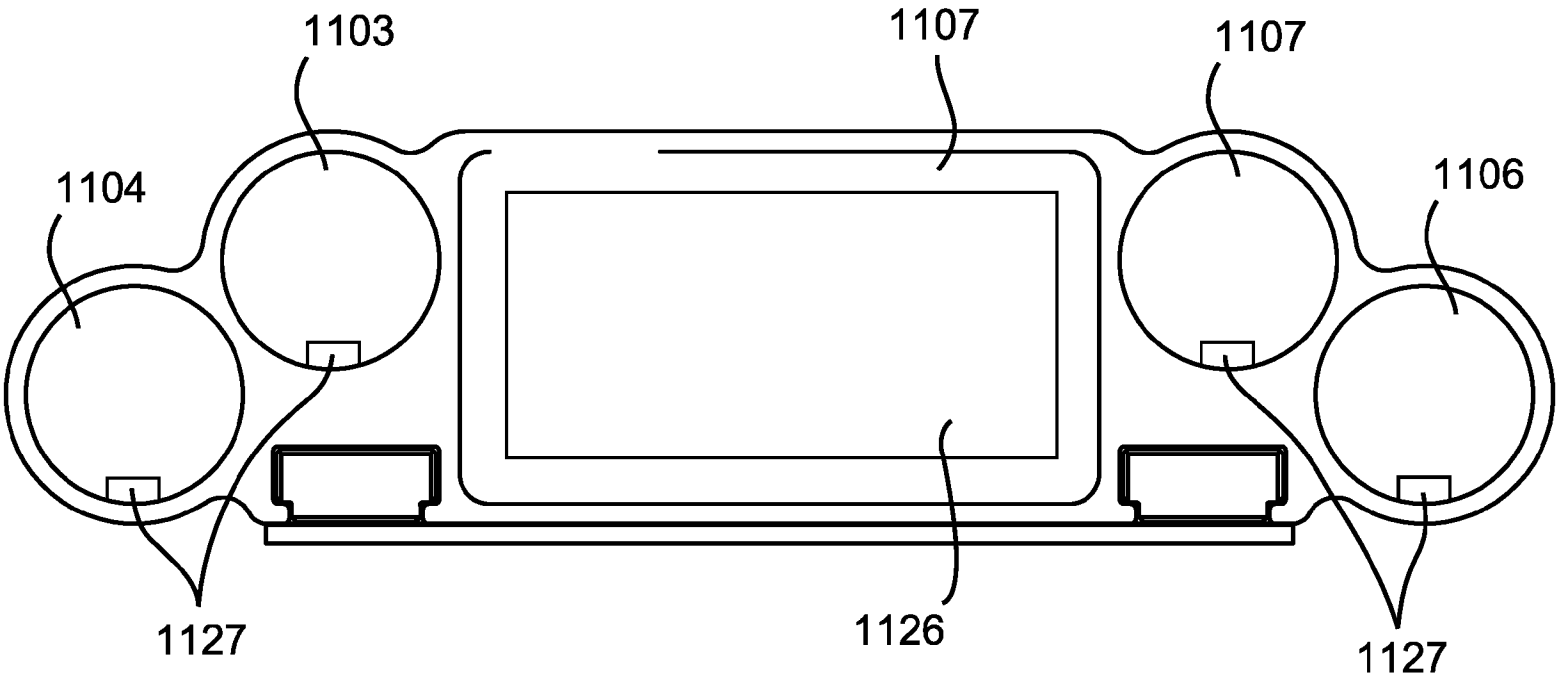
FIG. 11 shows the inside of four cylindrical recesses with resilient metal projections inside and the inside of the cuboid with Velcro at the bottom.

FIG. 11 shows an embodiment of a utility holder with four cylindrical recesses 1103, 1104, 1105, and 1106 each containing a resilient metal projection 1127 on the inside. The resilient metal projection 1127 applies pressure to a dry-erase marker placed in one or more of the cylindrical recesses 1103, 1104, 1105, or 1106 holding the marker in place no matter what position the invention is placed. The utility holder also has a central cuboid recess 1107 with a Velcro 1126 adhered to the bottom of the central cuboid recess 1126. The Velcro holds a dry-erase eraser in place if the dry-erase eraser has the corresponding Velcro piece in order to adhere to the Velcro 1126.

Figure 12:
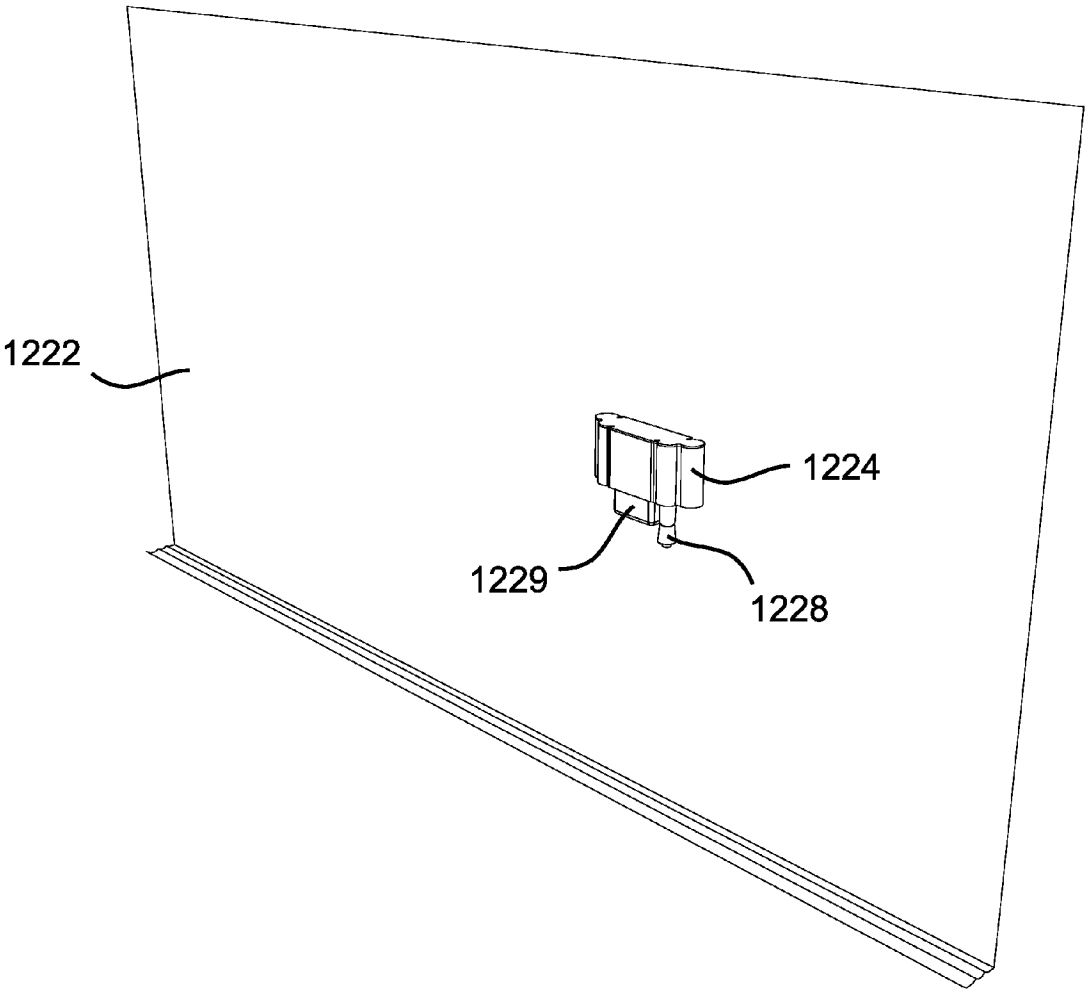
FIG. 12 shows an embodiment of a utility holder with an eraser in the central cuboid recess and a dry-erase marker in a cylindrical recess. The invention is upside down on a whiteboard.

FIG. 12 shows an embodiment of a utility holder 1224 placed upside down on a whiteboard 1222. A dry-erase marker 1228 is in one of four cylindrical recesses and a dry-erase eraser 1229 is in a central cuboid recess of the utility holder 1224. The dry-erase marker 1228 and the dry-erase eraser 1229 remain in the utility holder 1224 due to a resilient metal projection in the cylindrical recess and Velcro in the central cuboid recess.

Figure 13:
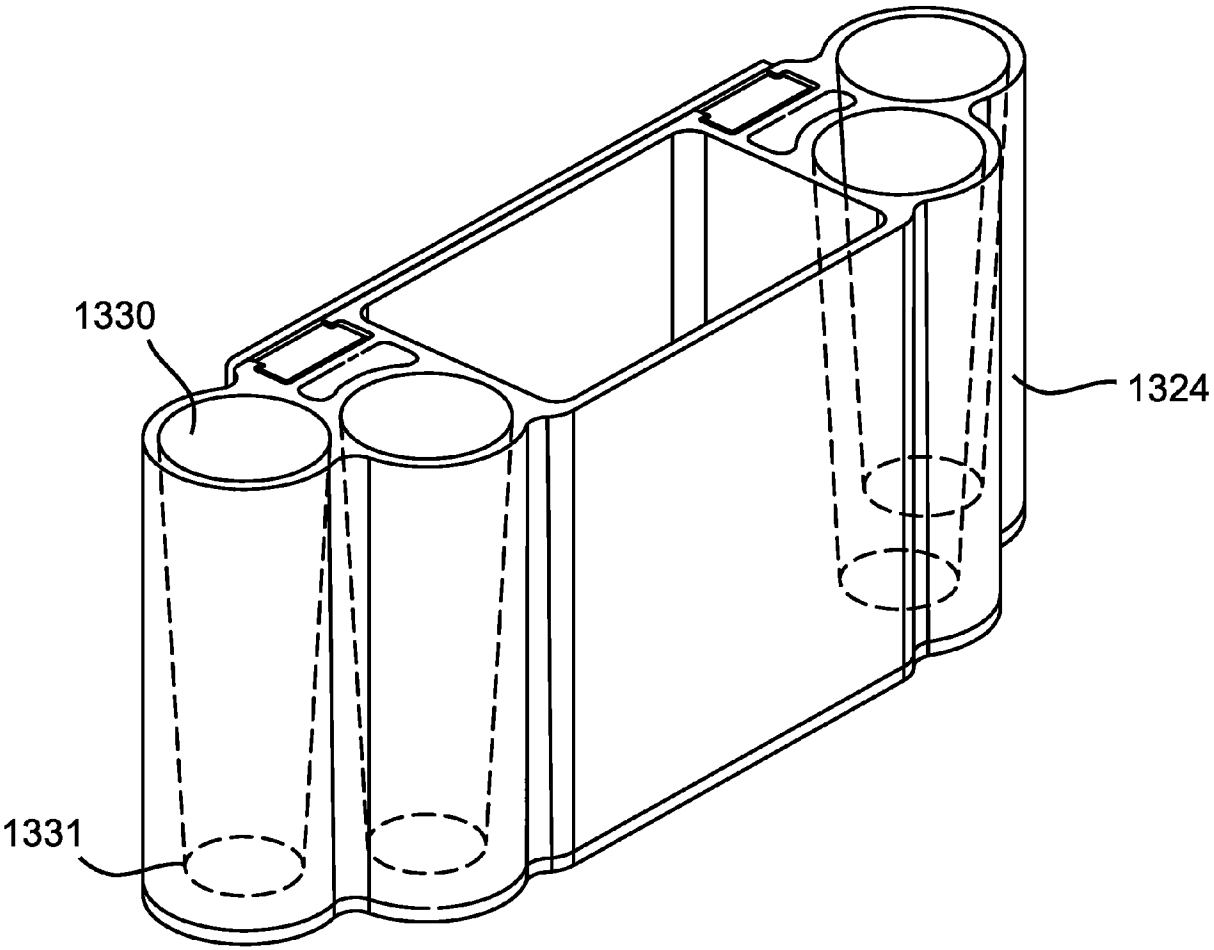
FIG. 13 shows a transparent view of a cylinder of an embodiment of a utility holder.

FIG. 13 shows a transparent view of a cylinder 1330 of an embodiment of a utility holder 1324. The cylinder 1330 comprises partially tapered walls at a distal end 1331 proximate a bottom wall, wherein when a dry-erase marker is inserted cap first into the cylinder 1330, the cap is held in place within the distal end 1331 when the marker is subsequently withdrawn by a user. The bottomless utility holder allows the cap to be removed by pushing the cap upward through the mouth of the cylinder.

The invention disclosed herein may be embodied in other specific forms without departing from their spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A whiteboard system, comprising:

a whiteboard comprising a magnetic surface;

a utility holder comprising an open interior defined by a bottom wall joining front, rear, and side walls;

the rear wall comprising one or more magnets for mounting the utility holder onto the whiteboard's magnetic surface;

the open interior comprising interior walls forming at least one cuboid;

the open interior further comprising interior walls forming a plurality of cylinders each suitable for storing a single whiteboard marker, each marker comprising a removable cap;

the open interior further comprising four vertical cylindrical recesses of equal height and diameter, arranged in two isometric vertical pairs rotated on a vertical axis on opposite sides of the cuboid, whereby an isosceles trapezoidal profile view is created from the top and from the bottom of the utility holder, with the four vertical cylindrical recesses equal in inner depth and outer height of each other and of the cuboid, and the cylinders comprising at least partially tapered walls at a distal end proximate the bottom wall, for holding the cap in place within the distal end when the marker is subsequently withdrawn by a user.

2. The whiteboard system of claim 1, wherein the utility holder comprises two parallel vertical channel-tracks of equal isometry and T-shaped from top and bottom views, situated on each side of the cuboid between the outer-most cylindrical recesses and the cuboid, wherein are embedded the two magnets, mounted substantially planar to the back surface.

3. The whiteboard system of claim 1, wherein one or more of the plurality of cylinders is suitable for storage and containment of a dry-erase marker.

4. The whiteboard system of claim 1, wherein one or more of the plurality of cylinders is suitable for storage and containment of a plurality of implements.

5. The whiteboard system of claim 1, wherein the cuboid is suitable for storage and containment of a dry-erase eraser.

6. The whiteboard system of claim 1, wherein the cuboid recess is suitable for storage and containment of one or more of dry-erase markers and a plurality of implements.

7. The whiteboard system of claim 1, wherein the whiteboard comprises:

a glass surface;

a white sheet of equal length and width as the glass surface placed directly behind the glass surface; and a metal sheet of equal length and width as the glass surface placed behind the white sheet.

8. The whiteboard system of claim 7, wherein the glass surface may be written on with a dry-erase marker and the metal sheet allows for the utility holder to adhere to the magnetic whiteboard due to magnetic attraction between the metal sheet and the one or more magnets.

9. The whiteboard system of claim 1, wherein the magnetic whiteboard has ferrous material or materials impregnated in the whiteboard.

10. The whiteboard system of claim 1, wherein the back surface of the utility holder is covered with a buffering material.

11. The whiteboard system of claim 10, wherein the buffering material is such that surface friction increases between the magnetized back surface of the utility holder and the magnetic whiteboard.

12. The whiteboard system of claim 10, wherein the buffering material is made of a felt or felt-like material such that the utility holder may be used as a dry-erase eraser.

13. The whiteboard system of claim 1, wherein a buffering material covers one or more of the back surface, a front surface, and a bottom surface of the utility holder.

14. The whiteboard system of claim 1, wherein the cylinders comprise a resilient metal projection that applies pressure to a dry-erase marker placed in any of the cylinders, which allows for the utility holder to be placed in any position without the dry-erase marker falling out.

15. The whiteboard system of claim 1, wherein the cuboid has Velcro adhered to the bottom of it, which allows for the utility holder to be placed in any position without a dry-erase eraser falling out of the cuboid given that the dry-erase eraser comprises the corresponding Velcro piece allowing it to adhere to the Velcro at the bottom of the cuboid.

16. The whiteboard system of claim 2, wherein the utility holder comprises two bean-shaped recesses situated on each side of the cuboid from front to back between the inner cylindrical recesses and the T-shaped magnets, and from side to side between the cuboid and the outer-most cylindrical recesses.

17. The whiteboard system of claim 1, wherein the cuboid recess is equal in width, from front to back, of 1.5 diameters of a single cylindrical recess.

18. The whiteboard system of claim 1, wherein the utility holder is made of one or more of: a polymeric material, wood, aluminum, an alloy, steel, and plastic.

19. The whiteboard system of claim 1, wherein the plurality of cylinders are bottomless.

* * * * *